US007476019B2

(12) United States Patent
Kubo

(10) Patent No.: US 7,476,019 B2
(45) Date of Patent: Jan. 13, 2009

(54) AGITATOR FOR MIXING OR AGITATING TARGET MATERIAL BY ROTATING VESSELS CONTAINING THE MATERIAL

(75) Inventor: Masakazu Kubo, Hirakata (JP)

(73) Assignee: BBC Soft, Inc., Osaka (JP)

( * ) Notice: Subject to any disclaimer, the term of this patent is extended or adjusted under 35 U.S.C. 154(b) by 525 days.

(21) Appl. No.: 11/286,952

(22) Filed: Nov. 25, 2005

(65) Prior Publication Data

US 2007/0076520 A1 Apr. 5, 2007

(30) Foreign Application Priority Data

Oct. 5, 2005 (JP) ..... 2005-291969

(51) Int. Cl.
*B01F 11/00* (2006.01)
*B01F 9/00* (2006.01)
*F16D 21/08* (2006.01)
*F16H 48/22* (2006.01)

(52) U.S. Cl. ..... 366/237; 192/51; 366/187; 366/232; 366/235; 475/224; 74/665 GC

(58) Field of Classification Search ..... 366/187, 366/220, 210, 211, 237, 238; 192/51; 60/908; 89/36.08; 475/27, 224; 74/665 G–665 GE
See application file for complete search history.

(56) References Cited

U.S. PATENT DOCUMENTS

831 A * 7/1838 Osgood, Jr. ..... 366/238
264,213 A * 9/1882 Alsing ..... 241/101.3
266,975 A * 11/1882 Crawford ..... 68/154
592,999 A * 11/1897 Ryan ..... 366/237
701,370 A * 6/1902 Mosebach, Jr. ..... 74/16
951,055 A * 3/1910 Clark ..... 74/323
1,205,324 A * 11/1916 Camp ..... 68/22 R
1,253,634 A * 1/1918 Schwanke ..... 74/355
1,344,366 A * 6/1920 Wichersham ..... 74/665 T
1,498,217 A * 6/1924 Walker ..... 74/665 GC (Continued)

FOREIGN PATENT DOCUMENTS

EP 1772185 A1 * 4/2007

(Continued)

OTHER PUBLICATIONS

Machine translation of JP 2005-28292 (JP 2003-196690).*
Machine translation of JP 2005-291969.*

*Primary Examiner*—David L Sorkin
*Assistant Examiner*—Andrew Janca

(57) ABSTRACT

The agitator of the present invention comprises: a drive source; a differential unit; a rotation-direction switching unit; and a brake unit. The drive source generates rotational driving forces. The differential unit and rotation-direction switching unit are positioned in a driving-force transmission path between agitation vessels containing agitation-target material. The brake unit alternately stops the rotation of two rotating shafts extended from the differential unit. Here, the differential unit of the agitator has functions of receiving the rotational driving forces from the drive source and transmitting the rotational driving forces to the two rotating shafts in a differential manner. The rotation-direction switching unit has a function of inverting the rotation direction of the rotational driving forces transmitted to the agitation vessel while the rotation of the rotating shaft is being stopped by a brake.

20 Claims, 6 Drawing Sheets

U.S. PATENT DOCUMENTS

| | | | | | |
|---|---|---|---|---|---|
| 1,611,310 | A | * | 12/1926 | Grant | 68/173 |
| 1,638,965 | A | | 8/1927 | Sherbondy | |
| 1,665,959 | A | * | 4/1928 | Graham et al. | 68/54 |
| 1,960,815 | A | * | 5/1934 | James et al. | 192/215 |
| 2,165,884 | A | * | 7/1939 | Chamberlin et al. | 8/159 |
| 2,317,117 | A | * | 4/1943 | Schmelzer | 74/606 R |
| 2,349,832 | A | * | 5/1944 | Replogle et al. | 406/36 |
| 2,353,554 | A | * | 7/1944 | Gates | 475/27 |
| 2,392,652 | A | * | 1/1946 | Dyer | 68/23.6 |
| 2,508,948 | A | * | 5/1950 | Hovermale | 68/12.19 |
| 2,635,726 | A | * | 4/1953 | Benjamin | 192/51 |
| 2,639,794 | A | * | 5/1953 | McNairy | 192/48.9 |
| 2,975,563 | A | * | 3/1961 | Bovensiepen | 451/262 |
| 3,706,443 | A | | 12/1972 | Oberhauser | |
| 3,958,434 | A | * | 5/1976 | Grunbaum | 68/27 |
| 4,024,935 | A | * | 5/1977 | Sugimoto | 192/225 |
| 4,162,129 | A | * | 7/1979 | Bartholemew, Jr. | 366/211 |
| 4,283,928 | A | * | 8/1981 | Stone | 68/23.7 |
| 5,205,141 | A | * | 4/1993 | Singh | 68/53 |
| 5,944,417 | A | | 8/1999 | Shiotani | |
| 6,342,021 | B1 | * | 1/2002 | Gleasman et al. | 475/18 |
| 7,065,905 | B2 | * | 6/2006 | Guinibert et al. | 34/603 |
| 7,197,901 | B2 | * | 4/2007 | Monteiro et al. | 68/24 |
| 2002/0023467 | A1 | * | 2/2002 | Seager et al. | 68/23 R |
| 2002/0050468 | A1 | * | 5/2002 | Moorehead | 210/104 |

FOREIGN PATENT DOCUMENTS

| | | | |
|---|---|---|---|
| FR | 704.439 | | 5/1931 |
| FR | 1390596 | * | 1/1965 |
| GB | 724317 | | 2/1955 |
| GB | 1096902 | * | 12/1967 |
| GB | 1096905 | * | 12/1967 |
| JP | 06-170203 | | 6/1994 |
| JP | 2001-286745 | | 10/2001 |
| JP | 2005-28292 | * | 2/2003 |

* cited by examiner

2000

CONTROL UNIT
X
Y
1
2
3
4
5
6
7
8a
8b
9a
9b
10a
10b
11a
11b
12a
12b
13a
13b
14a
14b
15a
15b
16a
16b
17a
17b
18a
18b
19a
19b
20a
20b
21a
21b
22a
22b
23a
23b
24a
24b
25a
25b
26a
26b
27a
27b
28a
28b
29a
29b
31a
31b
32a
32b
33a
33b
34a
34b
341a
342a
342b
45
50

AGITATOR FOR MIXING OR AGITATING TARGET MATERIAL BY ROTATING VESSELS CONTAINING THE MATERIAL

BACKGROUND OF THE INVENTION

[1] Field of the Invention

The present invention relates to a mixer for mixing multiple materials and an agitator for agitating or pulverizing one or more types of materials.

[2] Related Art

In the manufacture of chemicals and food products, agitators are generally used for mixing more than one material or pulverizing particulate matter. Some proposed agitators include: ones with a structure in which an agitating screw is provided within a vessel where material such as liquid and powder is poured, and the material in the vessel is agitated by rotating the screw (e.g. Japanese Patent Publication No. 3072467); and ones with a structure in which a screw-free agitation vessel itself, with material contained therein, is rotated, and the rotation direction of the agitation vessel is inverted by reversing the rotation direction of the motor at regular time intervals (e.g. Japanese Laid-Open Patent Application Publication No. 2002-1084). The agitator proposed in the latter reference rotates the agitation vessel while switching the rotation direction in regular intervals, and thereby produces highly efficient agitation of its contained material.

This agitator, proposed in Japanese Laid-Open Patent Application Publication No. 2002-1084 above, does not experience much difficulty in switching the rotation direction of the agitation vessel, which is achieved by switching the rotation direction of the drive source, such as a motor, between forward and reverse, if the agitation vessel and material contained therein have small masses.

In the case when the agitation vessel and contained material have rather large weights, however, inverting the rotation direction of the agitation vessel requires a substantial amount of energy, causing great energy loss, and also results in adding great loads to the motor of the drive source.

SUMMARY OF THE INVENTION

The present invention has been made in order to solve the above problem, and aims at offering an agitator that (i) achieves rotation of the vessels containing agitation-target material while switching the rotation direction at regular time intervals, and (ii) has low energy loss and exerts reduced loads on itself when switching the rotation direction.

In order to accomplish the above-stated object, the agitator of the present invention adopts the following structure.

The agitator of the present invention comprises: (a) a drive source operable to generate rotational driving forces; (b) a differential unit, having two rotating shafts extending therefrom, operable to receive the rotational driving forces and transmit the received rotational driving forces to the rotating shafts in a differential manner; (c) a brake unit operable to act on each of the rotating shafts and alternately stop the rotating shafts from rotating; (d) a rotation-direction switching unit, coupled to at least one of the rotating shafts, operable to output rotational driving forces from the coupled rotating shaft while switching a rotation direction of the coupled rotating shaft between forward and reverse; (e) an agitation vessel, 1) having therein a containing space for a material to be an agitation target, 2) coupled to the rotation-direction switching unit in a manner that enables input of the output rotational driving forces to the agitation vessel, and 3) having a rotatable structure; and (f) a control unit operable to output, based on a prestored drive sequence, control signals individually to each of the drive source, the differential unit, the brake unit and the rotation-direction switching unit.

The agitator of the present invention with the above characteristic features has the differential unit and brake unit operating based on the control signals sent from the control unit, and therefore, while the brake of one of the two rotating shafts is engaged, the rotational driving forces from the drive source are transmitted to the other rotating shaft in a differential manner. Additionally, the agitator of the present invention has the rotation-direction switching unit coupled to the rotating shaft, and the agitation vessel is coupled to the rotating shaft via the rotation-direction switching unit. Hence, the agitator of the present invention is capable of switching the rotation direction in a condition where the rotation is being stopped by applying the brake to the rotating shaft, and also capable of rotating the agitation vessel in the inverse direction from the rotation before the brake application by releasing the brake after the rotation direction is switched. Thus, the agitator of the present invention inverts the rotation direction of the agitation vessel without inverting that of the motor of the drive source each time, unlike the agitator proposed in Japanese Laid-Open Patent Application Publication No. 2002-1084.

Accordingly, the agitator of the present invention is able to rotate the vessel containing therein agitation-target material at regular time intervals while switching the rotation direction, and also has advantageous effects of obtaining low energy loss and exerting reduced loads on itself when switching the rotation direction.

The agitator of the present invention is able to adopt the following variations.

The agitator of the present invention is able to adopt a structure in which each of the rotating shafts is associated with a different one of rotation-direction switching units and a different one of agitation vessels. That is, the agitator comprises two or more agitation vessels, and these agitation vessels can be rotated using the rotational driving forces derived from a single drive source.

The agitator of the present invention is also able to adopt a structure in which the control unit transmits, to one of the rotation-direction switching units which is coupled to one of the rotation shafts whose rotation is being stopped by the brake unit, a control signal for causing the coupled rotation-direction switching unit to switch the rotation direction of the coupled rotation shaft between forward and reverse while the rotation is being stopped.

The agitator of the present invention is also able to adopt a structure in which the differential unit allocates the rotational drive forces from the drive source for the rotating shafts in proportion to loads exerted on the rotating shafts, and transmits the allocated rotational driving forces to each of the rotating shafts.

The agitator of the present invention is also able to adopt a following structure: in the agitation vessel, a dimple process is applied to an internal surface of the agitation vessel, surrounding the containing space. Thus, adopting the agitation vessels, to the internal surfaces of which the dimple process is applied, enables highly efficient agitation.

The agitator of the present invention is also able to adopt a following structure: in the agitation vessel, a discharge path is formed outwardly from a section, and a vicinity thereof, within an internal surface surrounding the containing space, the section lying, in a radial direction of rotation, furthest from a central axis of rotation. Adopting agitation vessels having such a structure allows the following advantageous effects to be obtained.

As to the agitator of the present invention adopting agitation vessels each having the above structure, even if the agitation vessels contain inside highly viscous material, it is possible to smoothly collect the fluid material to the outside of the agitation vessels by rotating the agitation vessels so as to apply, to the fluid material, centrifugal force that is larger than gravity. The agitator of the present invention achieves reliable collection regardless of the viscosity of the fluid material by setting the number of rotations of the vessels according, for example, to: the viscosity of material contained in the agitation vessels; the period of time that can be devoted for the collection; and an allowable amount of the material remaining in the vessels after the collection.

In each agitation vessel of the agitator according to the present invention, internal apertures of discharge paths are provided at a section, including the vicinity, furthest from the central axis of rotation in the radial direction of rotation, as described above. This structure is adopted because, when rotational motion is applied to the contained material by rotating the vessel, the fluid material is collected at the section where the internal apertures are provided.

Accordingly, the agitator of the present invention adopting the above agitation vessels is capable of reducing the amount of material remaining in the agitation vessels, regardless of the viscosity of the contained material, and is also effective to reduce the number of processes required for cleaning the inside of the vessels.

The agitator of the present invention is also able to adopt a structure in which the containing space is substantially spherical, and the discharge path is formed outwardly from an equator of rotation, and a vicinity thereof, on the internal surface surrounding the containing space.

The agitator of the present invention is also able to adopt a structure in which a valve operating mechanism operable to open and close the discharge path is positioned in the discharge path.

The agitator of the present invention is also able to adopt a structure in which a guide cover for collecting the material discharged from the discharge path due to rotation of the agitation vessel is positioned, at or in a vicinity of an outer circumference of the agitation vessel, so as to correspond to an outer end of the discharge path.

The agitator of the present invention may further comprise a collection container operable to rotate in synchronization with the agitation vessel and collect the material discharged from the discharge path, and the guide cover is rotatable in synchronization with both the agitation vessel and the collection container.

The agitator of the present invention which has an agitation vessel operable to contain a plurality of materials is applicable to a drive mode in which the plurality of materials contained in the agitation vessel are agitated due to rotation of the agitation vessel.

The agitator of the present invention which has an agitation vessel operable to contain granular or aggregated material is applicable to a drive mode in which the granular or aggregated material contained in the agitation vessel is pulverized due to rotation of the agitation vessel.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings.

DESCRIPTION OF PREFERRED EMBODIMENTS

The best modes for implementing the present invention are described next with the aid of drawings. Note that embodiments described hereinafter are merely examples for illustrating in a straightforward manner the structural characteristics and advantageous effects resulting from the structures of the present invention. Therefore, the present invention is not limited to the following embodiments, except for the technical features.

1. Embodiment 1

1.1 Structure

The overall structure of an agitator 1000 according to the present embodiment is described below with the aid of FIG. 1.

Figure 1:
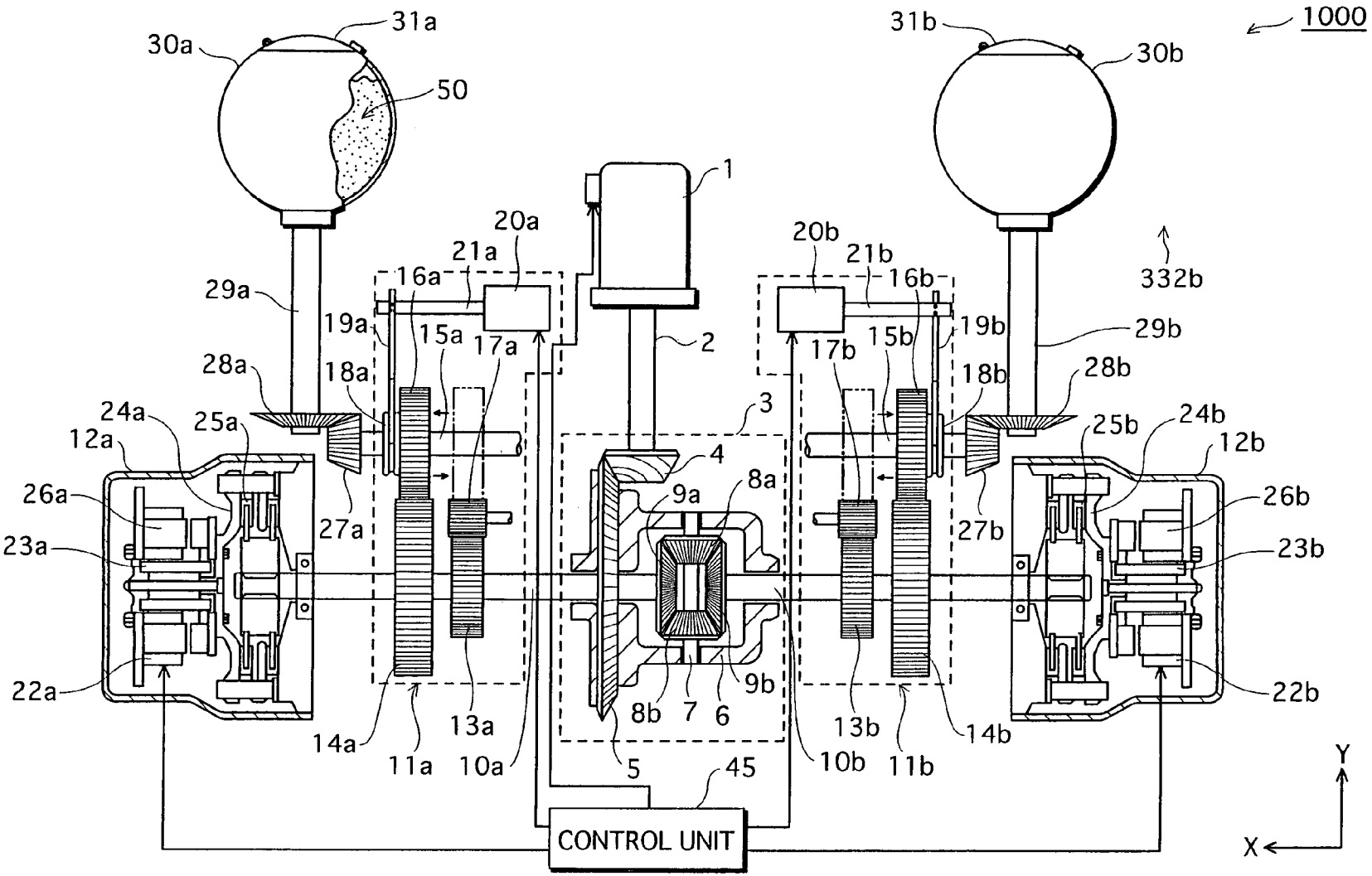
FIG. 1 is a schematic diagram showing a structure of an agitator 1000 according to Embodiment 1.

As shown in FIG. 1, the agitator 1000 of the present embodiment comprises: a drive motor 1 for supplying rotational driving forces; and two agitation vessels 30*a* and 30*b*. The drive motor 1 is connected to a differential block 3 by a driving shaft 2. Extended from the differential block 3 are two rotating shafts 10*a* and 10*b*, both of which are connected to rotation-direction switching blocks 11*a* and 11*b*, respectively.

Each rotating shaft 10*a*/10*b* is provided in a manner to penetrate and protrude through the rotation-direction switching block 11*a*/11*b*, and a brake block 12*a*/12*b* is positioned at the other end of each rotating shaft 10*a*/10*b*. A rotating shaft 15*a*/15*b* extends through the rotation-direction switching block 11*a*/11*b*, and is connected to the agitation vessel 30*a*/30*b* via a rotating shaft 29*a*/29*b* and others. The agitation vessels 30*a* and 30*b* adopted in the agitator 1000 of the present embodiment are hollow and roughly spherical. As to these agitator vessels 30*a* and 30*b*, intake lids 31*a* and 31*b* are respectively mounted to block off the openings at the upper parts, and liquid 50 is retained in the substantially spherical containing spaces.

Additionally, the agitator 1000 further comprises a control unit 45 for executing the drive control. The control unit 45 performs the drive control based on a drive program prestored in a memory (not shown) within the unit.

The differential block 3 has a publicly-known structure similar to one used for a drive system of passenger automobiles and the like, and includes: a ring gear 5; a case 6; a pinion shaft 7; differential pinions 8*a* and 8*b*; side gears 9*a* and 9*b*. To the driving shaft 2 extending from the drive motor 1, a drive pinion 4 is attached at the end and engages with the ring gear 5. One end of each rotating shaft 10*a*/10*b* is joined to the side gear 9*a*/9*b*. The differential block 3 transmits, to the two rotating shafts 10*a* and 10*b*, the driving force from the driving shaft 2 in a differential manner.

The rotation-direction switching blocks 11*a* and 11*b* are respectively connected to the two rotating shafts 10*a* and 10*b* joined to the differential block 3, and each includes: large-diameter gear 14*a*/14*b*; gears 13*a*/13*b* and 16*a*/16*b* each having a smaller diameter than the large-diameter gear 14*a*/14*b*; and a small gear 17*a*/17*b*. To the rotating shaft 15*a*/15*b* supporting the gear 16*a*/16*b*, a spool-shaped ring 18*a*/18*b* is attached in a manner that does not come in direct contact with the rotating shaft 15*a*/15*b*. Attached to each ring 18*a*/18*b* is a bifurcated lever 19*a*/19*b* connected to an electromagnetic solenoid 20*a*/20*b* via an operating shaft 21*a*/21*b*.

Here, each lever 19*a*/19*b* is capable of moving in the X direction in FIG. 1 due to the drive of the electromagnetic solenoid 20*a*/20*b* based on a control signal from the control unit 45. With this movement, the lever 19*a*/19*b* shifts the gear 16*a*/16*b* in the horizontal direction via the ring 18*a*/18*b*. Because of the shifting motion, in the rotation-direction switching block 11*a*/11*b*, the gear 16*a*/16*b* engages with either the gear 14*a*/14*b* or the gear 17*a*/17*b*.

The rotational driving forces derived from each rotating shaft 15*a*/15*b*, to which the gear 16*a*/16*b* is joined, are transmitted to the rotating shaft 29*a*/29*b* via the gear 27*a*/27*b* and the gear 28*a*/28*b*. The agitation vessel 30*a*/30*b* is joined to the rotating shaft 29*a*/29*b* at the end.

The brake blocks 12*a* and 12*b* are electromagnetic disc brakes, and each is positioned at the end of the rotating shaft 10*a*/10*b* extending from the differential block 3. Specifically speaking, the brake block 12*a*/12*b* includes: an electromagnetic coil 22*a*/22*b*; a spring 23*a*/23*b*; a disc 24*a*/24*b*; a pad 25*a*/25*b*; and a core 26*a*/26*b*. The brake blocks 12*a* and 12*b* alternately stop the rotation of the rotating shafts 10*a* and 10*b* based on an indication signal from the control unit 45. When a current is made to flow to the electromagnetic coil 22*a*/22*b* based on the control signal from the control unit 45, the disc 24*a*/24*b* is pulled toward the core 26*a*/26*b* against the force of the spring 23*a*/23*b*, and the disc 24*a*/24*b* is then separated from the pad 25*a*/25*b* to thereby release the brake. Note that, when a current is not flowing through the electromagnetic coil 22*a*/22*b*, the inverse operation from the one described above is performed to engage the brake.

1.2 Driving Method of Agitator 1000

The driving method of the agitator 1000 having the above structure is described next with the aid of FIG. 2.

Figure 2:
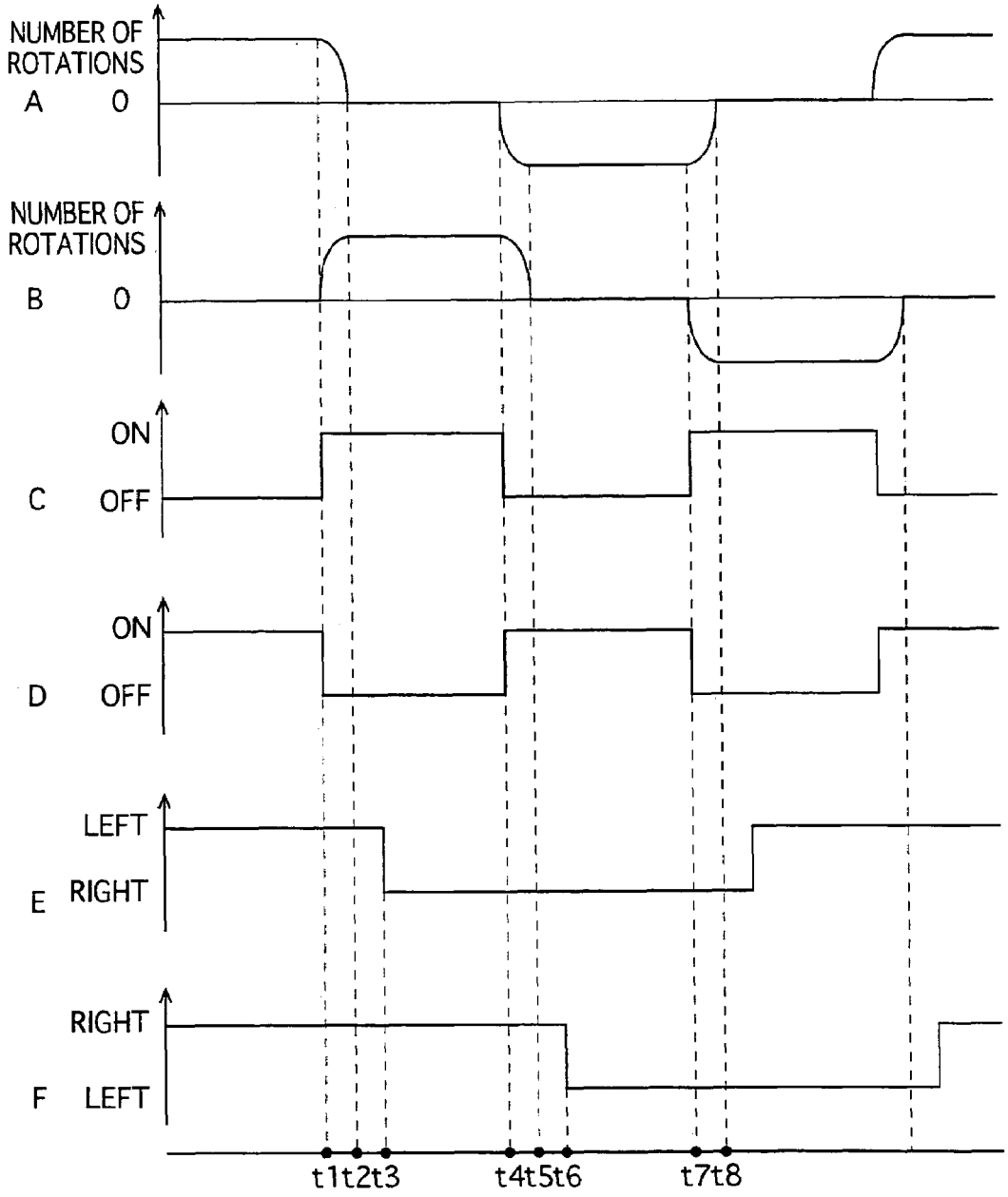
FIG. 2 is a time chart for describing operation of the agitator 1000.

In FIG. 2, individual sections (A to F) show the following: A) the rotation condition of the agitation vessel 30*a*; B) the rotation condition of the agitation vessel 30*b*; C) brake voltage applied to the brake block 12*a*; D) brake voltage applied to the brake block 12*b*; and E) and F) voltage for switching the rotation direction.

For driving the agitator 1000, as shown in FIG. 2, the liquid 50 is first fed into the agitation vessels 30*a* and 30*b*, and the intake lids 31*a* and 31*b* are closed. Then, prior to the drive motor 1 being driven, a control voltage is applied to the brake blocks 12*a* and 12*b* from the control unit 45 to thereby set the brake block 12*a* to an OFF state (the brake being released) and set the brake block 12*b* to an ON state (the brake being engaged). In this state of things, the rotational drive of the drive motor 1 is started by applying an operation-start signal to the drive motor 1 from the control unit 45.

In the condition described above, since the brake of the brake block 12*b* is engaged, the rotating shaft 10*b* does not rotate, while only the rotating shaft 10*a* starts its rotation. Then, the rotating shaft 29*a* is made to rotate via the gear 16*a* and rotating shaft 15*a* in the rotation-direction switching block 11*a* as well as via the gears 27*a* and 28*a*. As a result, the agitation vessel 30*a*, as shown on the left side of FIG. 1, starts rotating at a predetermined number of rotations.

In the agitator 1000, after the above drive state is carried on for a certain period of time, the brake voltage from the control unit 45 is switched at timing t1, as shown in FIG. 2. That is, the brake of the brake block 12*a* is engaged, while the brake of the brake block 12*b* being released. Subsequently, the agitation vessel 30*a* stops rotating at timing t2, as shown in the section A of FIG. 2. On the other hand, as shown in the section B of FIG. 2, the agitation vessel 30*b* starts its rotation at timing t1, and reaches a steady drive state at timing t2. As shown in the section E of FIG. 2, a voltage is applied to the electromagnetic solenoid 20*a* from the control unit 45 at timing t3, and the gear 16*a* shifts rightward to engage with the gear 17*a*. Now, the agitation vessel 30*a* is poised to invert its rotation. As shown in the sections C and D of FIG. 2, the brake voltage is switched at timing t4, and the brake is applied to the agitation vessel 30*b*. Then, the rotation of the agitation vessel 30*b* subsequently stops at timing t5. On the other hand, the agitation vessel 30*a* starts rotating in the inverse direction, and then reaches the steady drive state at timing t5. As shown in the section F of FIG. 2, the control unit 45 applies a voltage to the electromagnetic solenoid 20*b* at timing t6, and the gear 16*b* shifts leftward in FIG. 1 to engage with the gear 17*b*. Thus, the agitation vessel 30*b* is now poised to invert its rotation. From here onward, the rotation direction is switched at timings t7 and t8 in a similar fashion. Note that, as long as timing t3 is established between timings t2 and t4 and timing t6 is established between timings t5 and t7, the occurrences of timings t3 and t6 are not limited to the case shown in FIG. 2.

1.3 Advantageous Effects In the agitator 1000 of the present embodiment, as described above, the agitation vessels 30*a* and 30*b* rotate alternately—that is, when one agitation vessel is rotating, the other is in a stopped state. Then, when the agitation vessel currently in the stopped state starts its rotation, it will rotate in the inverse direction from the previous rotation. In the agitator 1000 of the present embodiment, as can be seen from a series of these movements, the rotating shaft 2 of the drive motor 1 is always rotating in only one direction. Thus, although the rotation directions of the agitation, vessels 30*a* and 30*b* are alternately switched between forward and reverse, there is no need to switch the rotation direction of the drive motor 1, which results in significantly high efficiency. Such movements being feasible is attributed to the operation of the differential block 3, and the energy loss is reduced since the rotation of one rotating shaft 10*a* (10*b*) accelerates when the rotation of the other rotating shaft 10*b* (10*a*) slows down.

The agitator 1000 of the present embodiment is capable of mixing food products and chemicals, for example. In the case of mixing food products, the contained food is free from damage during the agitation because the agitation vessels 30*a* and 30*b* of the agitator 1000 do not have therein blades or the like.

2. Embodiment 2

Figure 3:
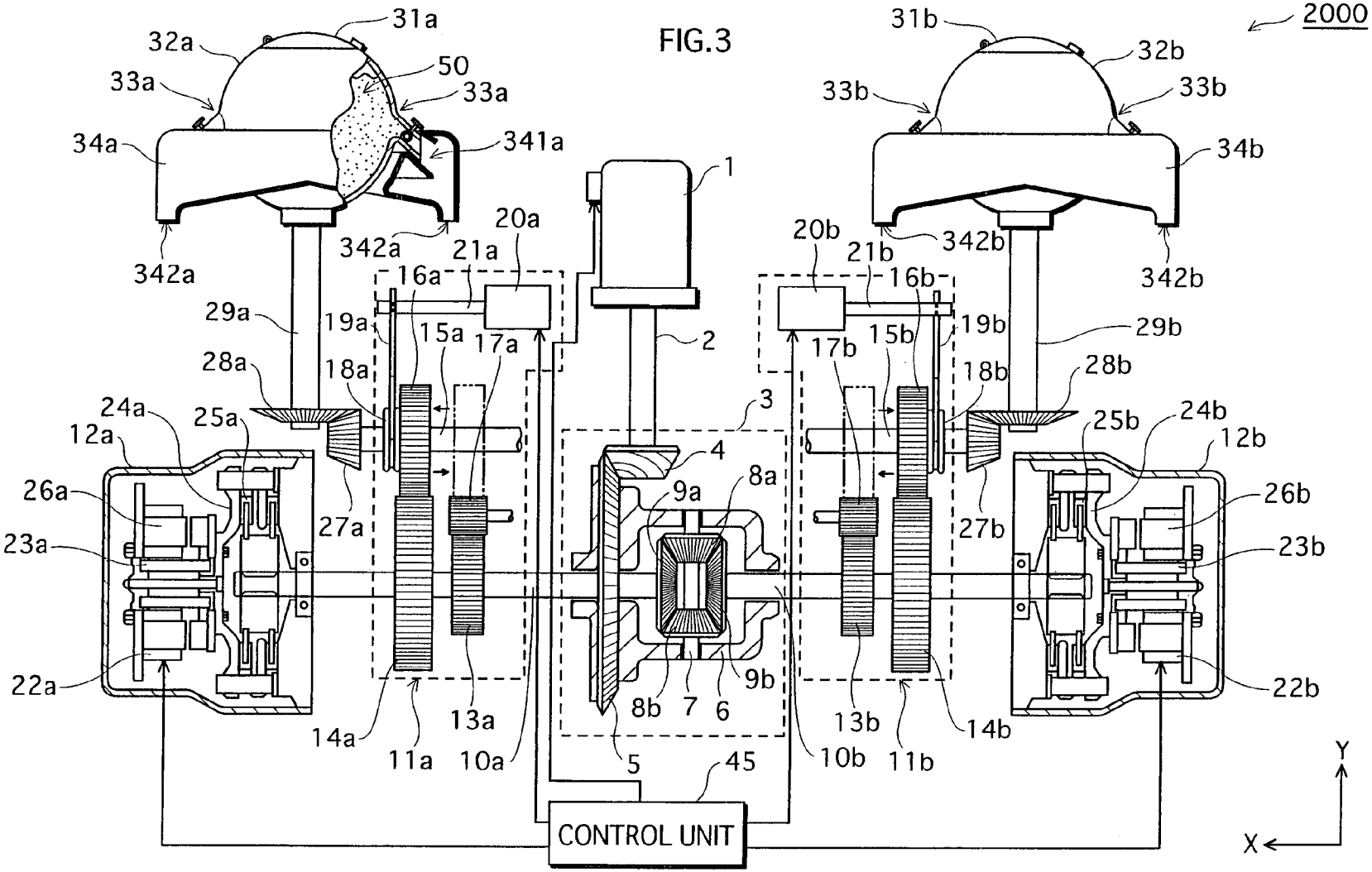
FIG. 3 is a schematic diagram showing a structure of an agitator 2000 according to Embodiment 2.
Figure 4:
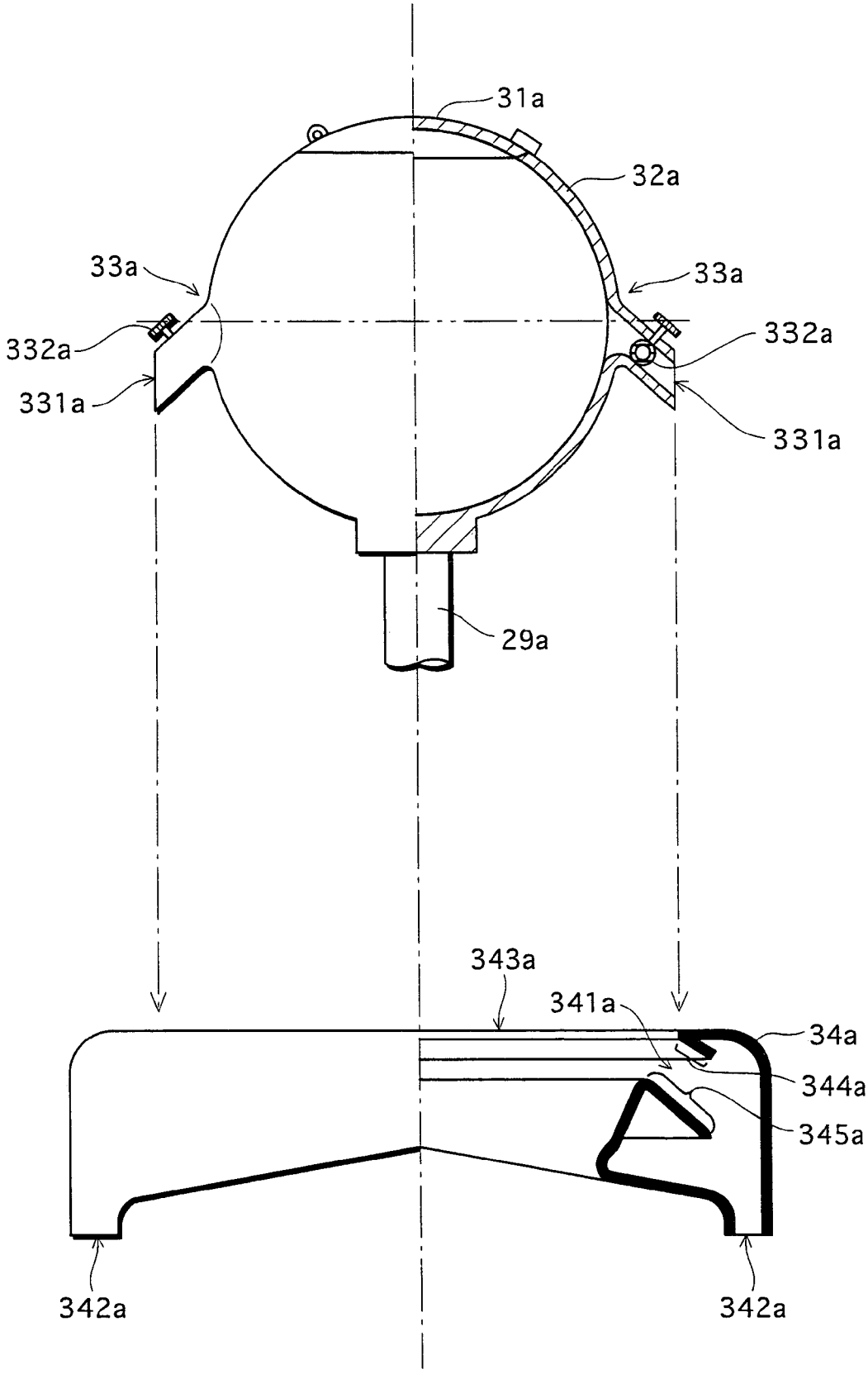
FIG. 4 is a lateral view (with a partially cutaway cross sectional view) showing structures of an agitation vessel 32 *a* and a collection ring 34*a* of the agitator 2000.

Next, an agitator 2000 according to Embodiment 2 of the present invention is described with the aid of FIGS. 3 to 5. Note that, in the following explanation, the same numerical symbols are used for the same components as in the agitator 1000 of Embodiment 1, and the descriptions of these components are omitted here.

2.1 Structure

The basic structure of the agitator 2000 of the present embodiment is, as shown in FIG. 3, the same as that of the agitator 1000 of Embodiment 1 above. Different characteristics of the agitator 2000 of the present embodiment, as compared to the above agitator 1000, are the configuration of agitation vessels 32*a* and 32*b* and attachments (i.e. collection rings 34*a* and 34*b*) positioned at the outer circumferences of the agitation vessels 32*a* and 32*b*. The following gives an account focusing on the differences of the agitator 2000 from the agitator 1000.

As shown in FIG. 3, the agitator 2000 of the present embodiment includes two agitation vessels 32*a* and 32*b*, on each of which two discharge nozzles 33*a*/33*b* are formed at the equator to face outward in the radial direction. Additionally, the agitator 2000 has collection rings 34*a* and 34*b* that are positioned to surround the outer circumferences of the agitation vessels 32*a* and 32*b*, respectively.

In each collection ring 34*a*/34*b*, a receiving opening 341*a* is formed throughout the entire circumference, at a location corresponding to the discharge nozzles 33*a*/33*b* provided on the agitation vessel 32*a*/32*b*. The receiving opening 341*a* receives the liquid 50 discharged from the discharge nozzles 33*a*/33*b* of each rotating agitation vessel 32*a*/32*b*. Note that the collection rings 34*a* and 34*b* remain stationary and do not rotate with the agitation vessels 32*a* and 32*b* in a rotating motion. In addition, the collection rings 34*a* and 34*b* and the like are fixed onto stationary portions of the agitator 2000—such as base plates and base frames—by support frames although this is not shown in FIG. 3 and other figures.

At the lower portion, in the Z direction, of each collection ring 34*a*/34*b*, two discharge outlets 342*a*/342*b* are formed on the periphery. The liquid 50 received from the receiving opening 341*a* is collected to the two discharge outlets 342*a*/342*b* by the collection ring 34*a*/34*b* functioning as a guide cover. In the actual collection process, collection containers are placed below the discharge outlets 342*a*/342*b* of the collection ring 34*a*/34*b* to receive the collected liquid 50.

As shown in FIG. 4, within each discharge nozzle 33*a* provided on the equator of the agitation vessel 32*a*, a ball valve 332*a* is positioned in the discharge path. When the liquid 50 is agitated using the agitator 2000, the ball valve 332*a* is closed to avoid spillage, while the ball valve 332*a* is opened when the liquid 50 is collected.

The collection ring 34*a* is, as described above, positioned to surround the outer circumference of the agitation vessel 32*a*, and part of the agitation vessel 32*a* is inserted into an aperture 343*a* of the collection ring 34*a*, created in the middle section. Additionally, the receiving opening 341*a* is formed to correspond to the discharge nozzles 33*a* when the agitation vessel 32*a* is inserted thereto. Inside the collection ring 34*a*, guide edges 344*a* and 345*a* are formed in order to prevent the liquid 50 from splashing between the receiving opening 341*a* and the discharge outlets 342*a*. These guide edges 344*a* and 345*a* are formed inside the collection ring 34*a* along the entire circumference.

Note that FIG. 4 shows only one of two agitation vessels 32*a* and 32*b* as well as one of two collection rings 34*a* and 34*b* provided in the agitator 2000—i.e. the agitation vessel 32*a* and the collection ring 34*a* shown on the left side of FIG. 3, however, the other agitation vessel 32*b* and collection ring 34*b* also have the same structures as their counterparts, respectively.

2.2 Collection Operation of Liquid 50 from Agitation Vessels 32*a* and 32*b*, and Advantageous Effects of Agitator 2000

Figure 5A:
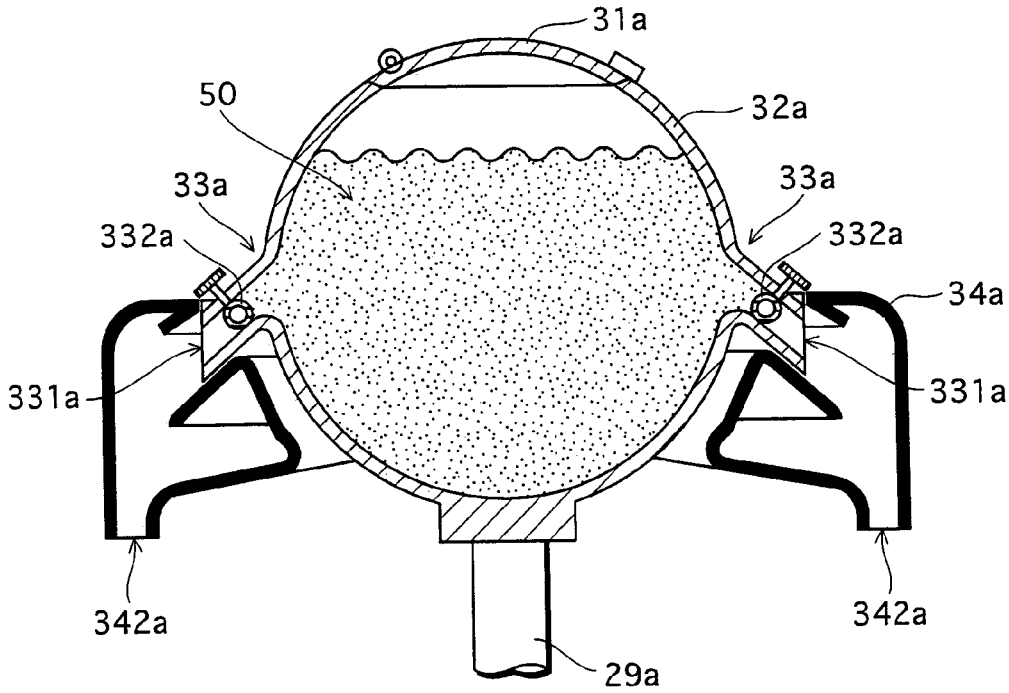
FIG. 5A is a schematic cross section showing a state in which liquid 50 is contained in the agitation vessel 32*a* of the agitator 2000.

When the ball valves 332*a* of the discharge nozzles 33*a* are closed, the liquid 50 is held inside the agitation vessel 32*a*, as shown in FIG. 5A. This configuration is used when the agitator 2000 carries out the agitation operation. The intake lid 31*a* is also closed tight before the agitation operation to prevent the liquid 50 from splashing out of the agitation vessel 32*a*.

Figure 5B:
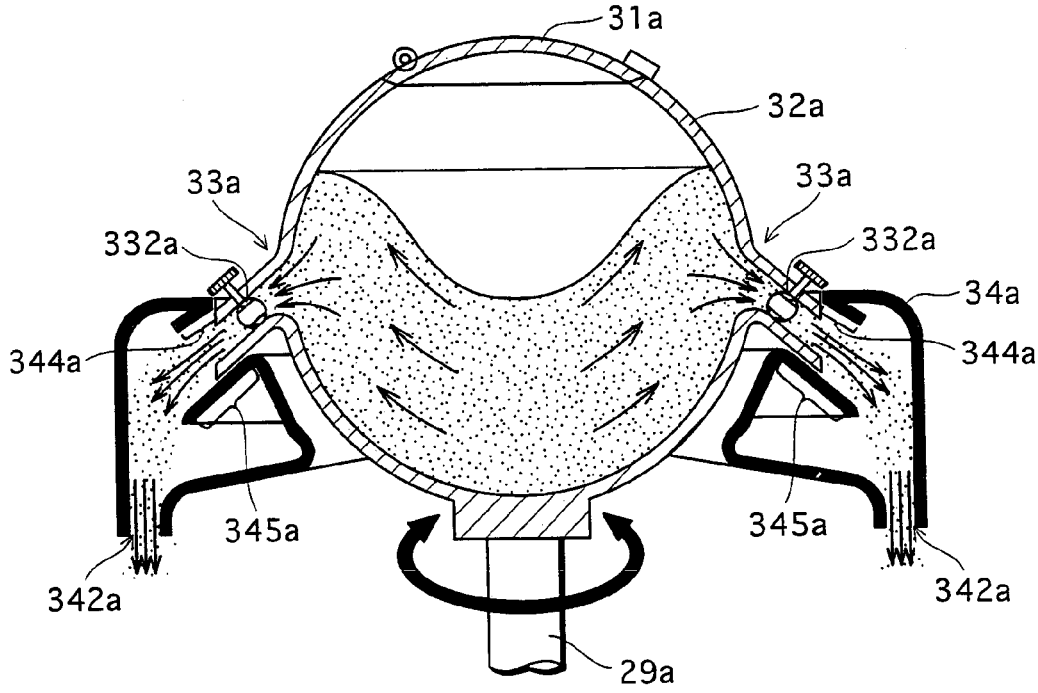
FIG. 5B is a schematic cross section showing a state in which the liquid 50 is being collected from the agitation vessel 32*a* of the agitator 2000.

Then, when the liquid 50 in the agitation vessel 32*a* is collected, collection containers (not shown in FIG. 5B) are first placed below the discharge outlets 342*a* of the collection ring 34*a*, and the ball valves 332*a* are opened, as shown in FIG. 5B. The agitation vessel 32*a* is subsequently set in rotation by starting the drive motor 1 of the agitator 2000. By using centrifugal force derived from this rotation, the liquid 50 is collected to the collection containers from the discharge nozzles 33*a* via the collection ring 34 *a*.

In the collection process of the liquid 50, since the guide edges 344*a* and 345*a* are provided inside the collection ring 34*a*, the liquid 50 discharged, from nozzle openings 331*a*, in the normal direction under centrifugal force is guided to the collection containers by these guide edges 344*a* and 345*a*.

On the agitation vessel 32*a* of the agitator 2000 according to the present embodiment, the discharge nozzles 33*a* are formed outwardly at the equator of the rotation operation being performed. It is designed to have the discharge nozzles 33*a* within the section where the largest portion of the liquid 50 under centrifugal force is distributed, and therefore the liquid 50 in the agitation vessel 32*a* is smoothly discharged in a reliable manner. The other agitation vessel 32*b* and the collection ring 34*b* attached thereto have the same operational and collection mechanisms as their counterparts, respectively.

As to the agitator 2000 of the present embodiment, therefore, it is less likely that the liquid 50 remains inside the agitation vessels 32*a* and 32*b* during the collection, which allows to eliminate or reduce the need for cleaning for an operation following the current collection operation. Although the number of rotations of the agitation vessels 32*a* and 32*b* for the collection of the liquid 50 in the agitator 2000 is arbitrarily set according, for instance, to the viscosity of the liquid 50 contained therein and the operating time that can be devoted for the collection, several dozen times per minute, for example, should suffice. Here, in the case if part of the liquid 50 still remains at the inside bottom of the agitation vessels 32*a* and 32*b* in the final step of the collection operation, the number of rotations of the agitation vessels 32*a* and 32*a* may be slightly increased correspondingly.

The description of the drive method of the agitator 2000 in relation to the agitation is left out since the method is essentially the same as that of the agitator of Embodiment 1 above. However, because of adopting the structure described above, the agitator 2000 is able to switch the rotation directions of the agitation vessels 32*a* and 32*a* between forward and reverse without changing the rotation direction of the drive motor 1 (the source of power) between forward and reverse. Namely, for driving the agitator 2000: 1) the drive motor 1 is started; 2) while the drive motor 1 is in the driving state, one of the brake blocks 12*a* and 12*b* is activated to thereby stop the rotation of one of the rotating shafts 10*a* and 10*b* extending from the differential block 3; 3) during this time, the rotation-direction switching block (11*a* or 11*b*) connected to the stopped rotating shaft (10*a* or 10*b*) is set in motion, and herewith the rotation direction of the rotating shaft (29*a* or 29*b*) is switched. Thus, although the brake is applied to one rotating shaft (10*a* or 10*b*) to thereby keep the rotation in the stopped state, rotational driving forces are continuously transmitted to the other rotating shaft (10*a* or 10*b*) due to the function of the differential block 3, which is a differential unit.

Therefore, by alternately applying a series of the above operation to two rotating shafts 10*a* and 10*b*, the agitator 2000 is able to alternately invert the rotation directions of the agitation vessels 32*a* and 32*a* while maintaining the rotation derived from the drive motor 1—i.e. the rotation of the driving shaft 2—steadily in a single direction. As a result, highly efficient agitation operation can be achieved. Furthermore, the agitator 2000 has advantageous effects in terms of a reduction in loads exerted on the drive motor 1 and shafts 2, 10*a*, 10*b*, 29*a* and 29*b*.

3. Embodiment 3

Figure 6:
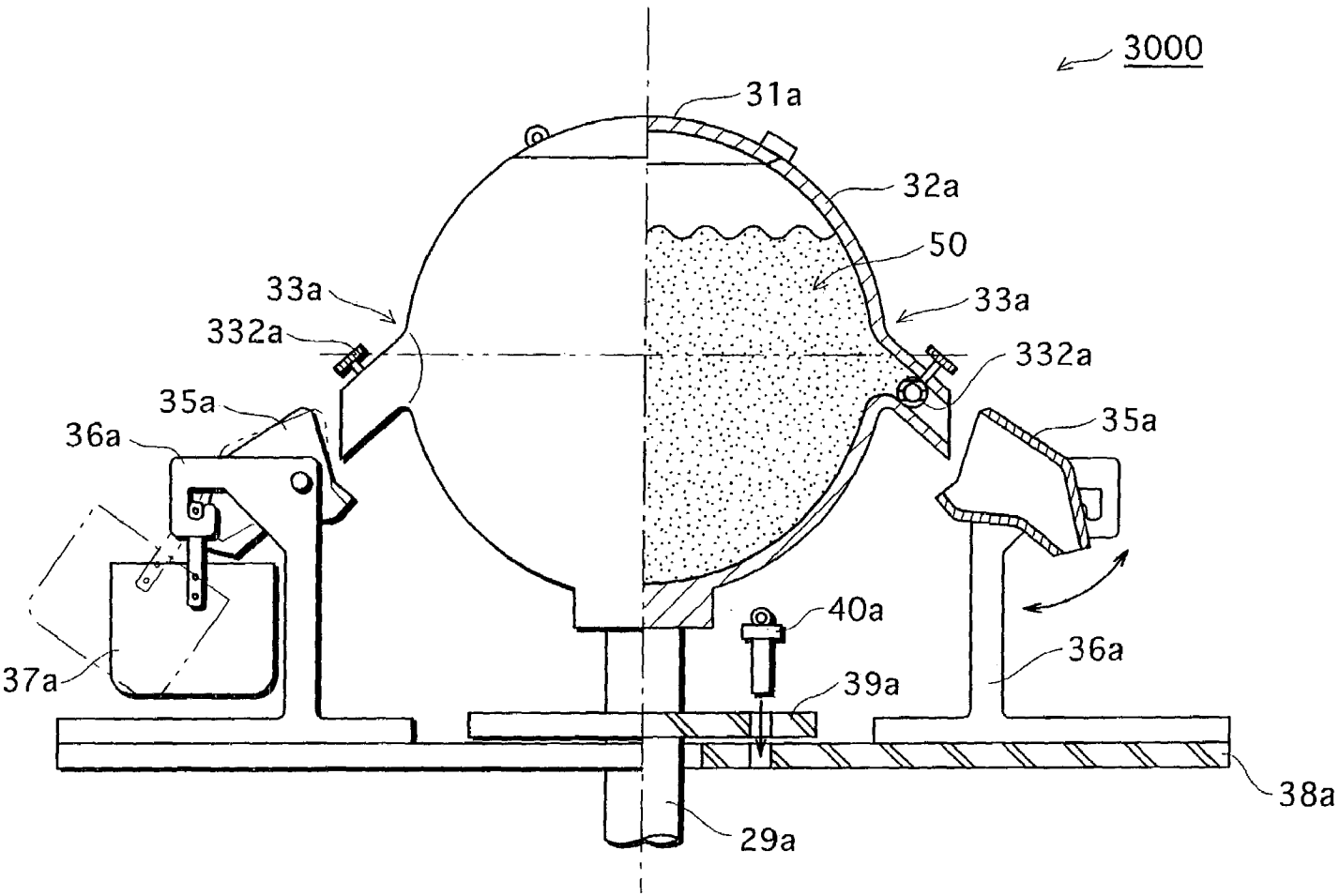
FIG. 6 is a lateral view (with a partially cutaway cross sectional view) showing structures of the agitation vessel 32*a* and a collection assist device 35*a*, which are characteristic components of an agitator 3000 according to Embodiment 3.

Next, the structure of an agitator 3000 according to Embodiment 3 is described with the aid of FIG. 6. Note that all the components of the agitator 3000 of the present embodiment are the same as those of Embodiment 2 above, except for guide cover portions accompanying the agitation vessels 32*a* and 32*b*, and thus a figure and a description regarding the structure of the agitator 3000 are left out here.

Unlike Embodiment 2 above, the agitator 3000 of the present embodiment does not have the collection ring 34*a*, surrounding the entire outer circumference of the agitation vessel 32*a*. Instead, collection containers 37*a* are positioned so as to correspond to the respective discharge nozzles 33*a* provided on the agitation vessel 32*a*, as shown in FIG. 6. In addition, between each pair of the discharge nozzle 33*a* and the collection container 37*a*, a funnel-shaped collection assist device 35*a* is positioned to ensure guiding the discharged liquid 50 into the collection container 37*a*

Each paired collection container 37*a* and collection assist device 35*a* are, individually, rotatably supported around an axis of rotation by a collection-container support frame 36*a* arranged in a standing manner on a disc-shaped collection-container base plate 38*a*. In the agitator 3000 of the present embodiment, a vessel base plate 39*a*, having a smaller diameter than the collection-container base plate 38*a*, is joined to the rotating shaft 29*a* which is joined to the agitation vessel 32*a*.

The collection-container base plate 38*a* and vessel base plate 39*a* can be engaged with each other by inserting a lock pin 40*a* into a hole provided in each plate. When these plates are engaged together by the insertion of the lock pin 40*a*, the agitation vessel 32*a*, collection containers 37*a* and collection assist devices 35*a* rotate in synchronization with one another due to the rotation of the rotating shaft 29*a*. The holes in the collection-container base plate 38*a* and vessel base plate 39*a* for the insertion of the lock pin 40*a* are arranged so that the collection assist devices 35*a* are positioned at the outlets of the discharge nozzles 33*a* when the plates are engaged with each other.

During the collection of the liquid 50 using the agitator 3000, the vessel base plate 39*a* and collection-container base plate 38*a* are engaged with each other by the inserted lock pin 40*a*, and then the agitation vessel 32*a*, collection containers 37*a* and collection assist devices 35*a* is made to rotate in synchronization with one another by setting the rotating shaft 29 in rotation. Subsequently, the liquid 50 is collected to the collection containers 37*a* due to centrifugal force of the rotation. The collection containers 37*a* and collection assist devices 35*a* each are designed to change their angles with the rotation of the rotating shaft 29*a*, as shown in FIG. 6. Herewith, the liquid 50 discharged from the discharge nozzles 33*a* is collected to the collection containers 37*a* without splashing outside.

The agitator 3000 also has another agitation vessel 32*b*, as in the case of the agitator 2000 according to Embodiment 2. The other agitation vessel 32*b* as well as the collection containers 37*a* and collection assist devices 35*a* accompanying thereto all have the same structures as their counterparts, respectively.

The agitator 3000 of the present embodiment achieves the same advantageous effects as the agitator 2000 of Embodiment 2 above. In addition, unlike Embodiment 2 above, the agitator 3000 of the present embodiment does not have the collection rings 34*a* and 34*b* surrounding the entire outer circumferences of the agitation vessels 32*a* and 32*a*. The collection assist devices 35*a* are provided at only positions corresponding to the respective discharge nozzles 33*a*. As a result, even if the collection assist devices 35*a* and the like need to be cleaned after every cycle of agitation and collection, it is possible to reduce the number of processes required for the cleaning.

4. Additional Particulars

Although, in the agitators 2000 and 3000 according to Embodiments 2 and 3 above, two discharge nozzles 33*a* and 33*b* are formed on each of the agitation vessels 32*a* and 32*b*, the number of discharge nozzles 33*a* and 33*b* are not confined to the case. Only one discharge nozzle, or alternatively three or more discharge nozzles may be provided for each agitation vessel, instead. Additionally, in Embodiments 2 and 3 above, the ball valves 332*a* are fitted in the discharge nozzles 33*a* and 33*b*, however, a structure other than this can be adopted if it allows to control retention and discharge of the liquid 50. For example, the following structure may be adopted: more than one aperture is created on the equator of the agitation vessel 32*a*; then, when the liquid 50 is retained inside, such as during the agitation process, ring bodies are fit tightly around the outer circumferences of the agitation vessels 32*a* and 32*b* so as to block off each aperture. On the other hand, when the liquid 50 is collected, the multiple apertures can be opened at once by taking the ring bodies off, which reduces the number of processes required for the collection process.

The agitator 1000 of Embodiment 1 has two agitation vessels 30*a* and 30*b*, while each of the agitators 2000 and 3000 of Embodiments 2 and 3 has two agitation vessels 32*a* and 32*b*. However, an agitator having three or more agitation vessels is also within the scope of the present invention. Additionally, in Embodiments 1 to 3, the liquid 50 is poured in each of the agitation vessels 30*a*, 30*b*, 32*a* and 32*b* to perform the agitation process, however, the agitation process may be carried out with one of the two agitation vessels empty (i.e. containing no liquid 50).

The agitators 1000 to 3000 of Embodiments 1 to 3 above have a structure in which the center of the containing space of each agitation vessel 30*a* and 32*a*/30*b* and 32*b* lies on the axis of the rotating shaft 29*a*/29*b*; however, it is not always necessary to adopt this structure.

In Embodiments 1, 2 and 3 above, the agitators 1000, 2000 and 3000 are used as examples of usage of containers for fluids; however, the present invention can also use other types of containers. For instance, the present invention may apply containers used for retaining food products, chemicals, cosmetics or the like therein. Specifically speaking, such containers include: ones for keeping viscous cosmetics, such as cosmetic creams and liquid foundations, and materials of these; and ones for preserving food products such as fermented soybean paste and ketchup.

As to the fluid containers of the agitators of the present invention (i.e. the agitation vessels 30*a*, 30*b*, 32*a* and 32*b*), the dimple or a groove process may be applied to their internal surfaces. Note, however, that it is desirable not to inhibit the transfer of the fluid material to the discharge paths during the collection process. Additionally, in Embodiments 1 to 3 above, the outer shape of each agitation vessel 30*a*/30*b*/32*a*/32*b* and the shape of its internal, containing space are both spherical. However, regarding the fluid containers of the present invention, the outer shape and the shape of the internal containing space are not limited to spherical. For example, both the outer shape and the internal containing space may be cylindrical or conical. In addition, the internal containing space and the outside appearance do not necessarily have the same shape—e.g. the internal containing space is spherical while the outer shape is columnar or cubic. Furthermore, 5-gallon cans or drums can be used for the agitation vessels 30*a*, 30*b*, 32*a* and 32*b*.

In the agitators 1000 to 3000 of Embodiments 1 to 3 above, the drive motor 1 using electric power as a source of energy is given as an example of a source of power, however, other means that produces rotational drive—e.g. a gasoline engine and a gas-turbine engine—may be used, instead. Additionally, although electromagnetic disc brakes are adopted as the brake blocks 12*a* and 12*b* in the agitator 1000 of Embodiment 1, other structures can be employed. For instance, electro-hydraulic disc brakes or retarder systems using magnetic forces may be applied. The rotation-direction switching blocks 11*a* and 11*b* are also not limited to the structures adopted in the embodiments above.

In addition, the agitation target of the agitator of the present invention is not limited to the liquid 50, which is used as an example in Embodiments 1 to 3 above, and any fluid material may be used for the target. The same effects can be achieved with not only liquid in a gel or sol state but also powder as well as a mixture of liquid and solid materials, for example. Furthermore, the agitators 1000 to 3000 can be used as pulverizers. Here, ceramic materials already pulverized to some extent are placed in and agitated to achieve finer pulverization. In this case, the efficiency of the pulverization will be enhanced by adding thereto a number of hard balls made of a different material.

Thus, the agitator of the present invention has a great range of applications, such as mixing, pulverizing, and simple agitation. Note that the term "agitation" cited in this specification has a broad sense—including agitation for mixing and for pulverization.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be constructed as being included therein.

What is claimed is:

1. An agitator comprising:

a drive source generating rotational driving forces;

a differential unit, having two rotating shafts extending therefrom, the differential unit receiving the rotational driving forces and transmitting the received rotational driving forces to the rotating shafts in a differential manner;

two brake units alternately activated to exert friction braking force on the rotating shafts and stopping the rotating shafts from rotating, one of the two brake units being provided for each of the two rotating shafts;

a rotation-direction switching unit, coupled to at least one of the rotating shafts, outputting rotational driving forces from the coupled rotating shaft while switching a rotation direction of the coupled rotating shaft between forward and reverse;

a plurality of agitation vessels, each of the agitation vessels, (i) having therein a containing space for a material to be an agitation target, (ii) coupled to the rotation-direction switching unit in a manner that enables input of the output rotational driving forces to each of the agitation vessels, and (iii) having a rotatable structure; and a control unit outputting, based on a prestored drive sequence, control signals individually to each of the drive source, the differential unit, the two brake units, and the rotation-direction switching unit.

2. The agitator of claim 1, wherein each of the rotating shafts is associated with a different one of rotation-direction switching units and a different one of the agitation vessels.

3. The agitator of claim 2, wherein the control unit transmits, to one of the rotation-direction switching units which is coupled to one of the rotation shafts whose rotation is being stopped by one of the two brake units, a control signal for causing the coupled rotation-direction switching unit to switch the rotation direction of the coupled rotation shaft between forward and reverse while the rotation is being stopped.

4. The agitator of claim 1, wherein the differential unit allocates the rotational drive forces from the drive source for the rotating shafts in proportion to loads exerted on the rotating shafts, and transmits the allocated rotational driving forces to each of the rotating shafts.

5. The agitator of claim 1, wherein in each of the agitation vessels, a dimple process is applied to an internal surface surrounding the containing space.

6. The agitator of claim 1, wherein in each of the agitation vessels, a discharge path is formed outwardly from a section, and a vicinity thereof, within an internal surface surrounding the containing space, the section lying, in a radial direction of rotation, furthest from a central axis of rotation.

7. The agitator of claim 6, wherein the containing space is substantially spherical, and the discharge path is formed outwardly from an equator of rotation, and a vicinity thereof, on the internal surface surrounding the containing space.

8. The agitator of claim 6, wherein a valve operating mechanism opening and closing the discharge path is positioned in the discharge path.

9. The agitator of claim 6, wherein a guide cover for collecting the material discharged from the discharge path due to rotation of the agitation vessel is positioned, at or in a vicinity of an outer circumference of the agitation vessel, so as to correspond to an outer end of the discharge path.

10. The agitator of claim 9, further comprising:

a collection container rotating in synchronization with the agitation vessel and collect the material discharged from the discharge path, wherein the guide cover is rotatable in synchronization with both the agitation vessel and the collection container.

11. The agitator of claim 1, wherein each of the agitation vessels contains a plurality of materials, and the plurality of materials contained in each of the agitation vessels are agitated due to rotation of the agitation vessel.

12. The agitator of claim 1, wherein each of the agitation vessels contain granular or aggregated material, and the granular or aggregated material contained in each of the agitation vessels is pulverized due to rotation of the agitation vessel.

13. The agitator of claim 1, wherein each of the agitation vessels rotate at a velocity to pulverize granular or aggregated material contained within each of the agitation vessels.

14. An agitator comprising:

a drive source generating rotational driving forces;

a differential unit having two rotating shafts extending therefrom, the differential unit receiving the rotational driving forces and transmitting the received rotational driving forces to the rotating shafts in a differential manner;

means for alternately exerting friction braking force on the rotating shafts and stopping the rotating shafts from rotating;

a rotation-direction switching unit, coupled to at least one of the rotating shafts, outputting rotational driving forces from the coupled rotating shaft while switching a rotation direction of the coupled rotating shaft between forward and reverse;

means for pulverizing granular material, the means for pulverizing granular material coupled to the rotation-direction switching unit; and a control unit outputting, based on a prestored drive sequence, control signals individually to each of the drive source, the differential unit, the means for alternately exerting friction braking force on the rotating shafts and stopping the rotating shafts from rotating, and the rotation-direction switching unit.

15. The agitator of claim 14, wherein the differential unit allocates the rotational drive forces from the drive source for the rotating shafts in proportion to loads exerted on the rotating shafts, and transmits the allocated rotational driving forces to each of the rotating shafts.

16. The agitator of claim 15, wherein the means for pulverizing granular material includes a plurality of agitation vessels and each of the agitation vessels include a containing space with dimples in an internal surface of the containing space.

17. The agitator of claim 16, wherein the containing space is substantially spherical, and in the agitation vessel, a discharge path is formed outwardly from an equator of rotation, and a vicinity thereof, within the internal surface of the containing space.

18. The agitator of claim 17, wherein the agitation vessel contains a plurality of hard balls of a size and configuration to engage the granular material wherein the granular material is contacted by the plurality of hard balls in motion within the agitation vessel.

19. An agitator for mixing chemical and food products comprising:

a drive source generating rotational driving forces;

a differential unit having two rotating shafts extending therefrom, the differential unit receiving the rotational driving forces and transmitting the received rotational driving forces to the rotating shafts in a differential manner;

means for alternately exerting friction braking force on the rotating shafts and stopping the rotating shafts from rotating;

a rotation-direction switching unit, coupled to at least one of the rotating shafts, outputting rotational driving forces from the coupled rotating shaft while switching a rotation direction of the coupled rotating shaft between forward and reverse;

a plurality of agitation vessels mixing chemical and food products coupled to the rotation-direction switching unit in a manner that enables input of the output rotational driving forces to each of the agitation vessels, each of the agitation vessels having a rotatable structure and including a containing space that is substantially spherical with an internal surface, wherein the containing space stores the chemical and food products, the containing space includes a plurality of dimples in the internal surface to aid in mixing the chemical and food products, and a discharge path is formed outwardly from an equator of rotation within the internal surface of the containing space; and a control unit outputting, based on a prestored drive sequence, control signals individually to each of the drive source, the differential unit, the means for alternately exerting friction braking force on the rotating shafts and stopping the rotating shafts from rotating, and the rotation-direction switching unit.

20. The agitator of claim 19, wherein the chemical and food products include a plurality of granular material and the agitation vessel contains a plurality of hard balls of a size and configuration to engage the granular material wherein the granular material is contacted by the plurality of hard balls in motion within the agitation vessel.

* * * * *